US009716362B2

(12) United States Patent
Liang

(10) Patent No.: US 9,716,362 B2
(45) Date of Patent: Jul. 25, 2017

(54) ROTATING SAFETY OUTLET

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Jia-Hua Liang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/013,745

(22) Filed: Feb. 2, 2016

(65) Prior Publication Data

US 2017/0155223 A1 Jun. 1, 2017

(30) Foreign Application Priority Data

Dec. 1, 2015 (CN) ..... 2015 1 0858985

(51) Int. Cl.
*H01R 35/04* (2006.01)

(52) U.S. Cl.
CPC ..... *H01R 35/04* (2013.01)

(58) Field of Classification Search
USPC ..... 439/11, 13, 21, 20, 651, 652, 111
See application file for complete search history.

(56) References Cited

U.S. PATENT DOCUMENTS

| | | | | |
|---|---|---|---|---|
| 2,942,224 | A * | 6/1960 | Messing | F16J 1/16 439/111 |
| 6,196,851 | B1 * | 3/2001 | Gerard | H01R 35/04 439/20 |
| 6,302,743 | B1 * | 10/2001 | Chiu | H01R 25/003 439/22 |
| 7,249,976 | B1 * | 7/2007 | Watson | H01R 13/71 200/51.07 |
| 7,500,854 | B2 * | 3/2009 | Gottstein | H01R 25/006 439/13 |
| 7,753,682 | B2 * | 7/2010 | Gerard | H01R 13/652 439/13 |
| 9,325,132 | B2 * | 4/2016 | Hsu | H01R 31/06 |
| 9,450,365 | B1 * | 9/2016 | Baldwin | H01R 35/04 |

* cited by examiner

*Primary Examiner* — Alexander Gilman
(74) *Attorney, Agent, or Firm* — Steven Reiss

(57) ABSTRACT

A rotating safety outlet includes an outer case and a rotating piece defining plug holes and received inside the outer case and configured to rotate relative to the outer case. A pair of power conducting pieces is coupled to the rotating piece. A pair of latching assemblies is coupled to the outer case. The rotating piece is rotated along a predetermined angle of rotation by a plug inserted into the plug holes. The plug inserted into the plug holes resists against the power conducting pieces. When the rotating piece is rotated along the predetermined angle of rotation, the pair of power conducting pieces contacts the pair of latching assemblies to cause the plug, the pair of power conducting pieces, and the pair of latching assemblies to be electrically coupled together. A latching assembly locks the rotating piece in place after being rotated along the predetermined angle of rotation.

8 Claims, 6 Drawing Sheets

ROTATING SAFETY OUTLET

CROSS-REFERENCE TO RELAYED APPLICATIONS

This application claims priority to Chinese Patent Application No. 201510858985.6 filed on Dec. 1, 2015, the contents of which are incorporated by reference herein.

FIELD

The subject matter herein generally relates to outlets, and more particularly to a rotating safety outlet capable of cutting off an electric current when a plug is not inserted therein.

BACKGROUND

Generally, an outlet carries a high voltage, which can cause harm to anyone who carelessly touches a power conducting piece of the outlet.

BRIEF DESCRIPTION OF THE DRAWINGS

Implementations of the present technology will now be described, by way of example only, with reference to the attached figures.

DETAILED DESCRIPTION

Figure 1:
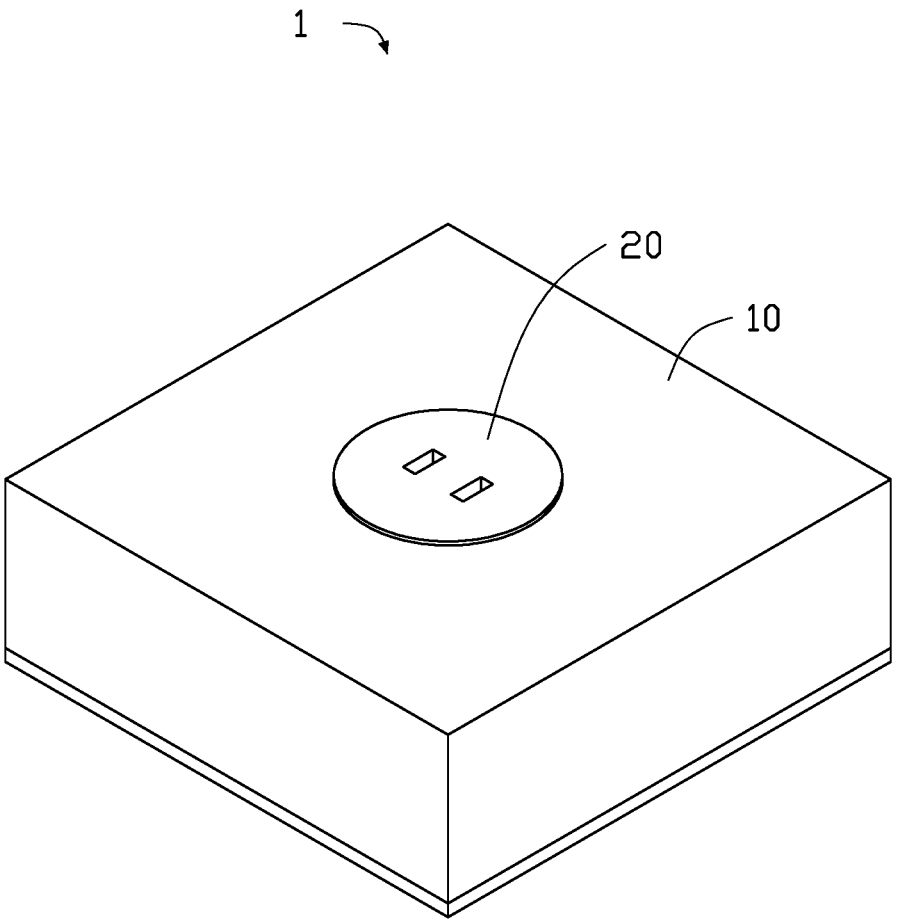
FIG. 1 is an assembled, isometric view of an embodiment of a rotating safety outlet.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 illustrates an embodiment of a rotating safety outlet 1. The rotating safety outlet 1 can include an outer case 10 and a rotating piece 20. The rotating piece 20 can rotate relative to the outer case 10.

Figure 2:
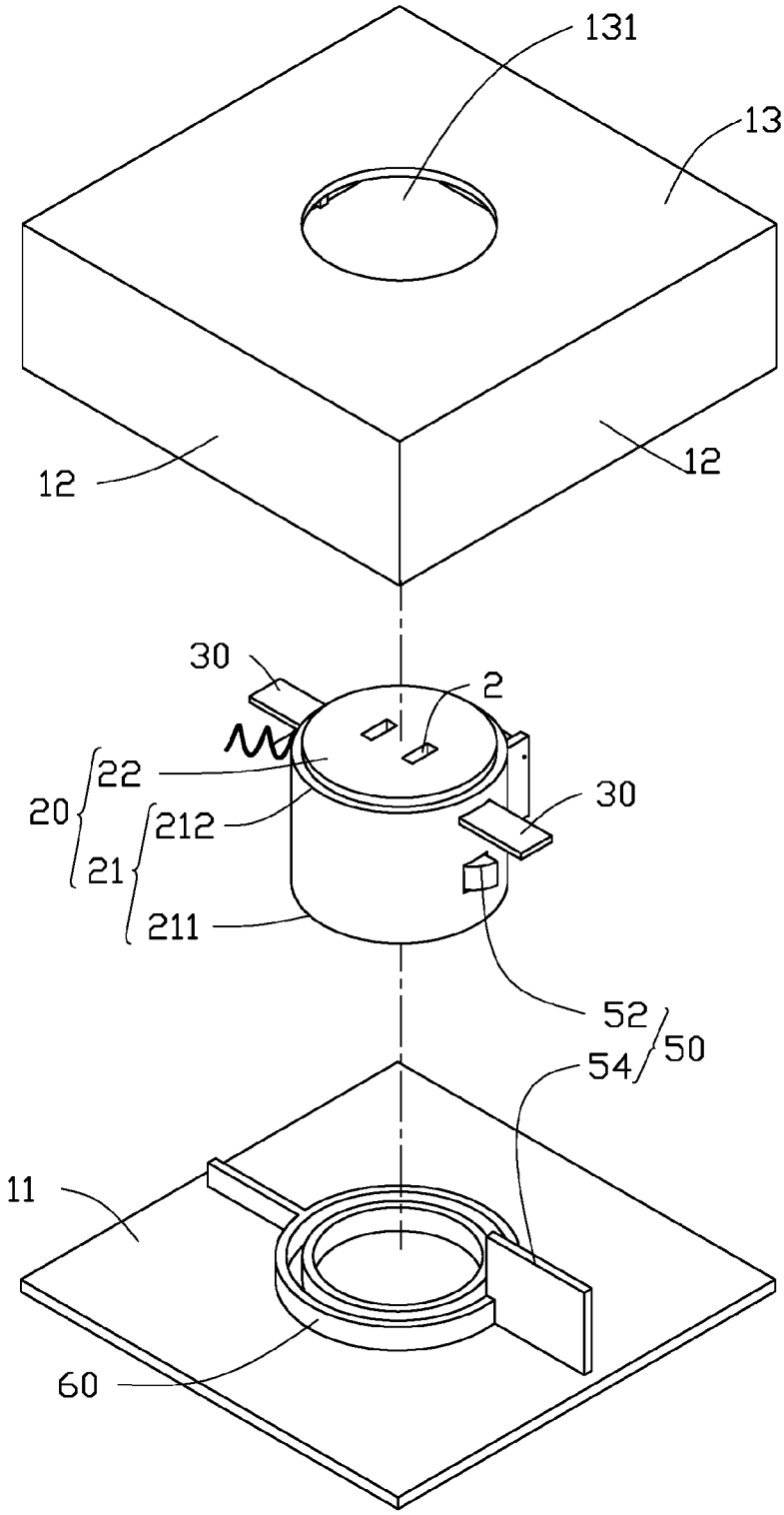
FIG. 2 is an exploded view of the rotating safety outlet of FIG. 1.
Figure 3:
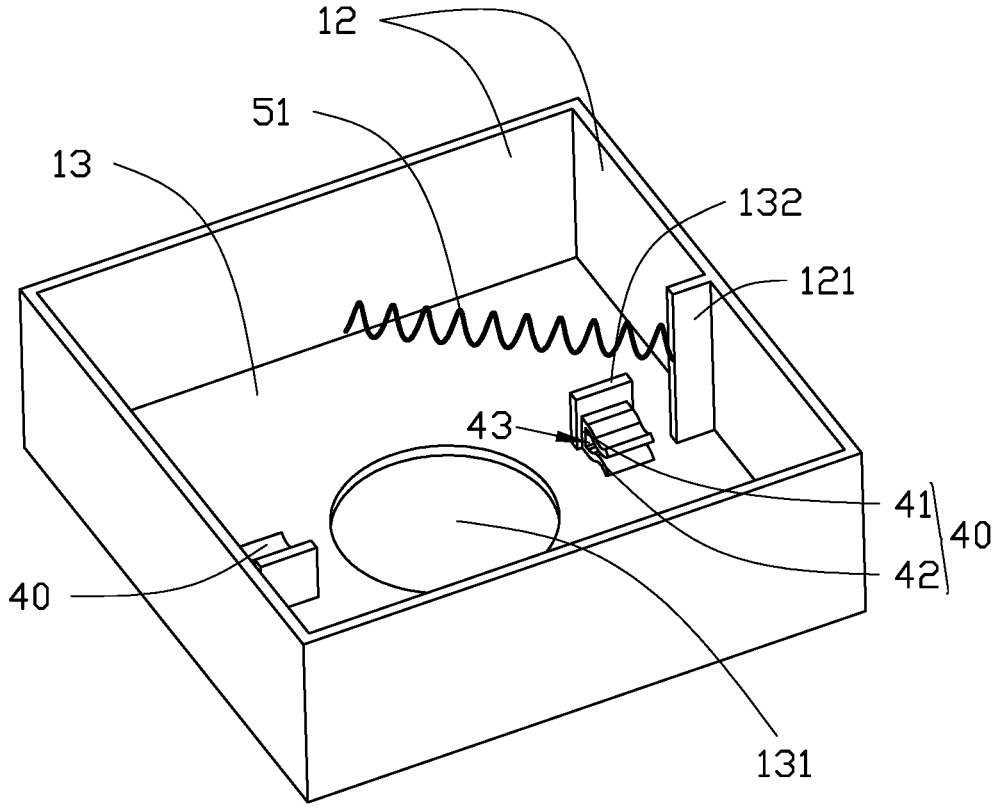
FIG. 3 is an isometric view of a case cover of the rotating safety outlet.
Figure 4:
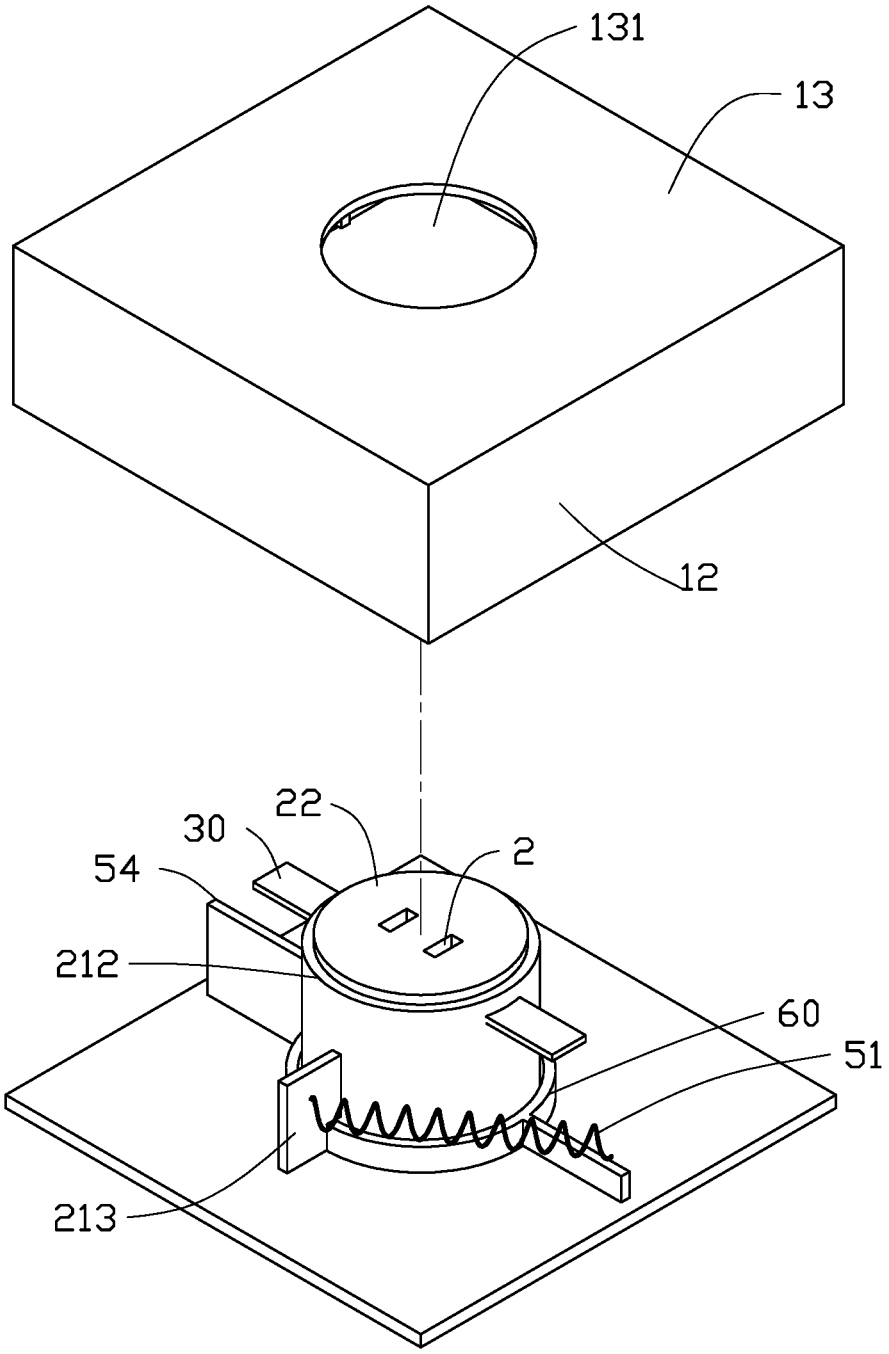
FIG. 4 is a partially exploded view of the rotating safety outlet of FIG. 1.

As illustrated in FIGS. 2-4, the rotating safety outlet 1 can include a pair of power conducting pieces 30, a pair of latching assemblies 40, and a locking assembly 50. The pair of power conducting pieces 30 can be coupled to the rotating piece 20, and the pair of latching assemblies 40 can be coupled to the outer case 10. The rotating piece 20 can define plug holes 2. When a plug (not shown) is inserted into the plug holes 2 and rotates the rotating piece 20 along a predetermined angle of rotation, the pair of power conducting pieces 30 can contact the pair of latching assemblies 40 to electrically couple the plug, the pair of power conducting pieces 30, and the pair of latching assemblies 40 together. The locking assembly 50 can lock the rotating piece 20 in place after being rotated along the predetermined angle of rotation.

In at least one embodiment, the rotating piece 20 can be a substantially hollow cylindrical structure. The rotating piece 20 can include a main body 21 and a cover 22. A bottom surface 211 of the main body 21 can define an opening (not labeled). The cover 22 can be located on a top surface 212 of the main body 21. The cover 22 and the top surface 212 can form a step. In at least one embodiment, the rotating piece 20 can be formed by plastic injection molding.

The outer case 10 can include a base 11, a plurality of walls 12 extending from the base 10, and a case cover 13 positioned on the plurality of walls 12. In the illustrated embodiment, there are four walls 12. The base 11 can define an annular groove 60, and the bottom surface 211 of the main body 21 can be received in the annular groove 60 to limit the rotating piece 20 to rotate along the annular groove 60. The case cover 13 can define a hole 131 corresponding in position to the rotating piece 20. A size of the hole 131 can be substantially the same as a size of the cover 22, and the cover 22 can extend through the hole 131. In at least one embodiment, a distance (not labeled) between the case cover 13 and the base 11 is substantially the same as a height of the main body 21.

Figure 5:
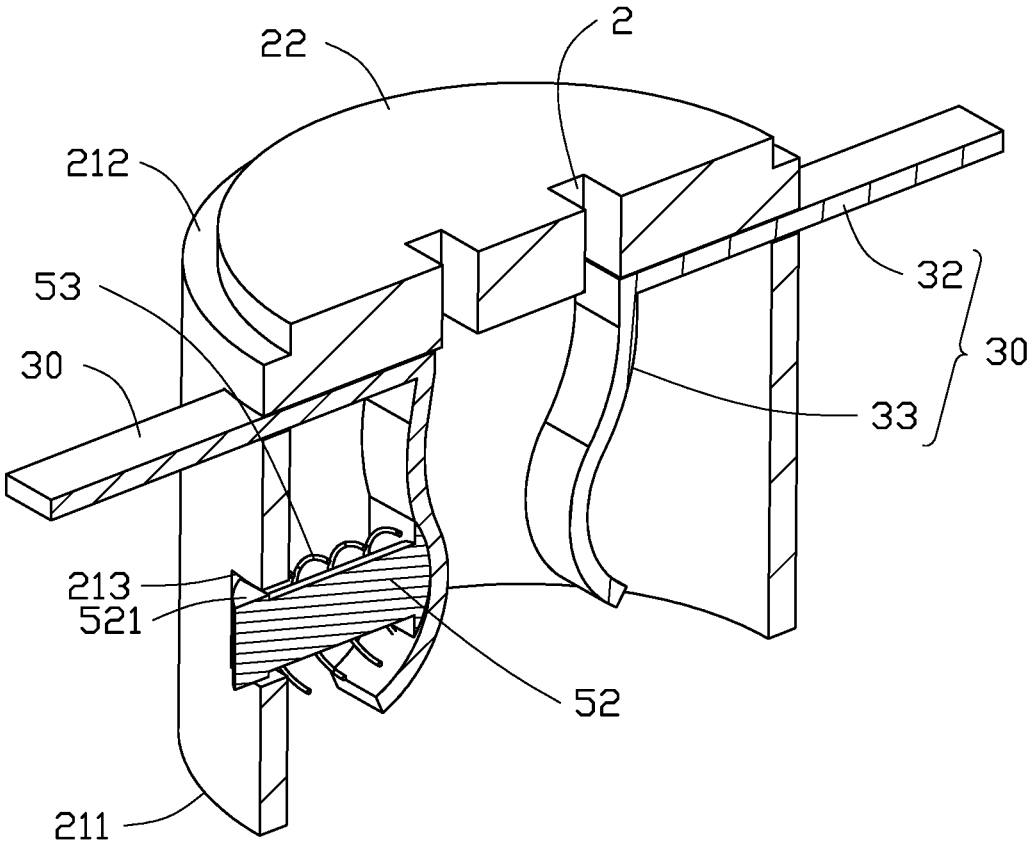
FIG. 5 is a partial cross-sectional view of a rotating piece of the rotating safety outlet.

As illustrated in FIG. 5, the pair of power conducting pieces 30 can be coupled to the main body 21 of the rotating piece 20. Each power conducting piece 30 can include a connecting portion 32 and a resisting portion 33. The resisting portion 33 can extend from the connecting portion 32 at an angle. In at least one embodiment, the resisting portion 33 can be curved and extend toward the base 10. The connecting portion 32 can extend out of the main body 21, and the resisting portion 33 can be located inside the main body 21. When the plug is inserted into the plug holes 2, the plug can resist against the resisting portions 33. In at least one embodiment, the resisting portions 33 can be S-shaped. The pair of power conducting pieces 30 can be made of metal.

As illustrated in FIG. 3, a surface of the case cover 13 facing toward the base 11 can include two installation pieces 132. Each latching assembly 40 can be installed on one corresponding installation piece 132. Each latching assembly 40 can include a planar piece 41 and two curved pieces 42. The planar piece 41 can be positioned on the corresponding installation piece 132. Each of the curved pieces 42 can extend from the planar piece 41. The planar piece 41 and the two curved pieces 42 can cooperatively define a receiving space 43 for receiving the connecting portion 32 of the corresponding power conducting piece 30. When the plug is inserted into the plug holes 2 and rotates the rotating piece 20 along the predetermined angle of rotation, the connecting portions 32 of the pair of power conducting pieces 30 can be received in the receiving spaces 43 to electrically couple the pair of power conducting pieces 30 to the pair of latching assemblies 40.

As illustrated in FIG. 4 and FIG. 5, the locking assembly 50 can include an elastic element 51, a locking piece 52, a spring 53, and a blocking piece 54. The elastic element 51 can be coupled between one of the walls 12 of the outer case 10 and the main body 21 of the rotating element 20. A first coupling element 121 can be located on the corresponding one of the walls 12 of the outer case 10 for coupling to a first end of the elastic element 51, and a second coupling element 213 can be located on the main body 21 of the rotating element 20 for coupling to a second end of the elastic element 51. When the rotating piece 20 is rotated along the predetermined angle of rotation, the elastic element 51 can be stretched. When the plug is removed from the plug holes 2, a restoring force of the elastic element 51 can restore the rotating element 20 to rotate along the predetermined angle of rotation such that the pair of power conducting pieces 30 is decoupled from the pair of latching assemblies 40.

The locking piece 52 can be coupled to the resisting portion 33 of one of the power conducting pieces 30. An end portion of the locking piece 52 located away from the resisting portion 33 can include a locking head 521. A locking hole 213 corresponding in position to the locking head 52 can be defined in the main body 21 of the rotating piece 20. The spring 53 can be sleeved on the locking piece 52 and be positioned between an inner wall of the main body 21 of the rotating piece 20 and the resisting portion 33 of the power conducting piece 30. When the plug is not inserted in the plug holes 2, the locking head 52 does not extend out of the locking hole 213. The blocking piece 54 can be positioned on the base 11 of the outer case 10. The blocking piece 54 can latch with the locking head 52 when the rotating piece 20 is rotated along the predetermined angle of rotation to lock the rotating piece 20 in place.

Figure 6:
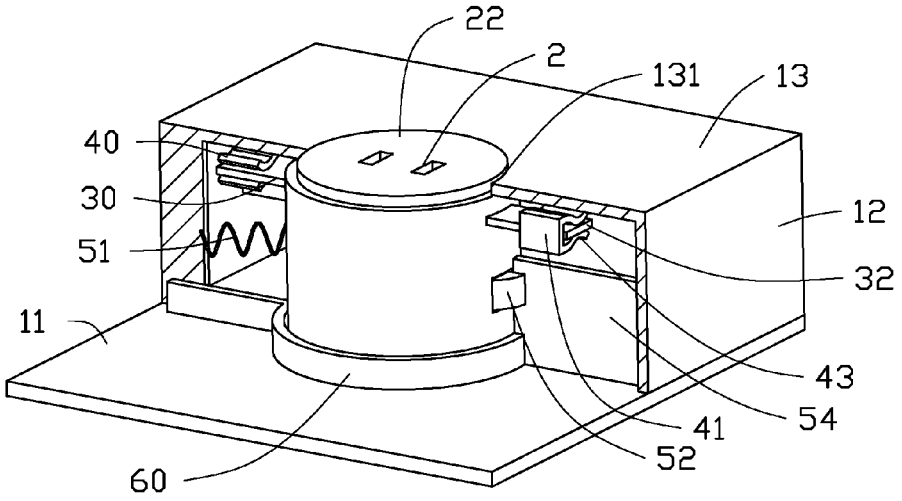
FIG. 6 is a cutaway, assembled view of the rotating safety outlet.

As illustrated in FIG. 5 and FIG. 6, in at least one embodiment, the locking head 521 has a cambered surface. When the plug is inserted into the plug holes 2, the plug can resist against the resisting portion 33, thereby compressing the spring 53 and extending the locking head 521 out of the locking hole 213. When the plug rotates the rotating piece 20 along the predetermined angle of rotation, the locking head 521 can move past the blocking piece 521, and the blocking piece 521 can latch with the locking head 52 to lock the rotating piece 20 in place. When the plug is removed from the plug holes 2, a restoring force of the spring 53 can retract the locking head 52 back into the locking hole 213 to unlock the rotating piece 20. Because the restoring force of the elastic element 51 decouples the pair of power conducting pieces 30 from the pair of latching assemblies 40, electric current is cut off from the pair of power conducting pieces 30. Thus, safety of the rotating safety outlet 1 is improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A rotating safety outlet for providing power to a plug, the rotating safety outlet comprising:

an outer case;

a rotating piece defining a plurality of plug holes and configured to be received inside the outer case and rotated relative to the outer case;

a pair of power conducting pieces coupled to the rotating piece;

a pair of latching assemblies coupled to the outer case and corresponding to the pair of power conducting pieces; and a locking assembly configured to lock the rotating piece in place after the rotating piece is rotated along a predetermined angle of rotation;

wherein the rotating piece is configured to be rotated along the predetermined angle of rotation by a plug inserted into the plug holes;

wherein the pair of power conducting pieces is configured to resist the plug that is inserted into the plug holes; and wherein when the rotating piece is rotated along the predetermined angle of rotation, the pair of power conducting pieces contacts the pair of latching assemblies, whereby the pair of power conducting pieces and the pair of latching assemblies are configured to be electrically coupled to the plug;

wherein:

the rotating piece is a hollow cylindrical structure;

the rotating piece comprises a main body and a cover;

a bottom surface of the main body is a ridge surrounding an opening defined in the bottom surface; and the cover is positioned on a top surface of the main body;

wherein:

the outer case comprises a base, a plurality of walls extending from the base, and a case cover positioned on the plurality of walls;

the base defines an annular groove;

the bottom surface of the main body of the rotating piece is received in the annular groove to allow the rotating piece to rotate along the annular groove;

the case cover defines a hole corresponding in position to the cover of the rotating piece; and the cover of the rotating piece extends out of the hole.

2. The rotating safety outlet as in claim 1, wherein a step is formed between the top surface of the main body of the rotating piece and the cover.

3. The rotating safety outlet as in claim 1, wherein a distance between the case cover and the base of the outer case is equal to a height of the main body of the rotating piece.

4. The rotating safety outlet as in claim 1, wherein:

the pair of power conducting pieces is coupled to the main body of the rotating piece;

each power conducting piece comprises a connecting portion and a resisting portion connected to the connecting portion and extending toward the base of the outer case;

the connecting portion extends out of the main body, and the resisting portion is located inside the main body; and the resisting portion is configured to resist against the plug inserted through the plug holes.

5. The rotating safety outlet as in claim 4, wherein:

the locking assembly comprises a locking piece, a spring, and a blocking piece;

the locking piece is coupled to the resisting portion of one of the power conducting pieces;

an end portion of the locking piece located away from the resisting portion comprises a locking head;

a locking hole corresponding in position to the locking head is defined in the main body of the rotating piece;

the locking head, when no plug is inserted in the plug holes, does not extend out of the locking hole;

the locking head, when there is a plug inserted in the plug holes and the rotating piece is rotated along the predetermined angle of rotation, extends out of the locking hole;

the spring is sleeved on the locking piece and is positioned between an inner wall of the main body of the rotating piece and the resisting portion of the flange; and the blocking piece is positioned on the base of the outer case and is configured to latch with the locking head when the rotating piece is rotated along the predetermined angle of rotation to lock the rotating piece in place.

6. The rotating safety outlet as in claim 5, wherein:

the case cover comprises two installation pieces located on a surface of the case cover facing toward the base;

each latching assembly is installed on one corresponding installation piece;

each latching assembly comprises a planar piece and two curved pieces, each curved piece extending from the planar piece; and the two curved pieces and the planar piece cooperatively define a receiving space for receiving the connecting portion of one of the corresponding power conducting pieces when the rotating piece is rotated along the predetermined angle of rotation.

7. The rotating safety outlet as in claim 6, wherein:

the locking assembly comprises an elastic element coupled between one of the walls of the outer case and the main body of the rotating element;

a first coupling element is located on the corresponding one of the walls of the outer case for coupling to a first end of the elastic element, and a second coupling element is located on the main body of the rotating element for coupling to a second end of the elastic element;

the elastic element is stretched when the rotating piece is rotated along the predetermined angle of rotation; and a restoring force of the elastic element, when the rotating piece has the plug removed from the plug holes, restores the rotating element to rotate along the predetermined angle of rotation such that the pair of power conducting pieces is decoupled from the pair of latching assemblies.

8. The rotating safety outlet as in claim 5, wherein:

the locking head has a cambered surface;

when there is the plug inserted into the plug holes, the resisting portions of the pair of power conducting pieces are configured to resist against the plug, thereby causing the spring to be compressed and the locking head to extend out of the locking hole;

the locking head, when the rotating piece is rotated along the predetermined angle of rotation, moves past the blocking piece, and the blocking piece latches with the locking head to lock the rotating piece in place; and when the rotating piece has the plug removed from the plug holes, a restoring force of the spring retracts the locking head back into the locking hole to unlock the rotating piece.

* * * * *